United States Patent [19]

Kies et al.

[11] Patent Number: 4,459,891

[45] Date of Patent: Jul. 17, 1984

[54] APPARATUS FOR PUNCHING HOLES IN BOARDS

[75] Inventors: Jared R. Kies, Perrysburg; Steve A. Oravecz, Maumee, both of Ohio

[73] Assignee: Owens-Corning Fiberglas Corporation, Toledo, Ohio

[21] Appl. No.: 421,923

[22] Filed: Sep. 23, 1982

[51] Int. Cl.[3] ..... B26F 1/24

[52] U.S. Cl. ..... 83/867; 83/348; 83/660

[58] Field of Search ..... 83/867, 30, 348, 660

[56] References Cited

U.S. PATENT DOCUMENTS

| | | | |
|---|---|---|---|
| 3,074,303 | 1/1963 | Waters | 83/660 X |
| 3,079,826 | 3/1963 | Shively | 83/660 X |
| 3,526,349 | 9/1970 | Moro | 83/660 X |
| 3,789,710 | 2/1974 | Silverstein | 83/660 X |
| 4,037,499 | 7/1977 | Hillman | 83/867 |
| 4,326,909 | 4/1982 | Slavik | 83/30 X |

FOREIGN PATENT DOCUMENTS

| | | | |
|---|---|---|---|
| 38017 | 11/1971 | Japan | 83/660 |

*Primary Examiner*—James M. Meister

*Attorney, Agent, or Firm*—Ronald C. Hudgens; Philip R. Cloutier; Paul J. Rose

[57] ABSTRACT

The apparatus includes a rotatably mounted roll having an elastomeric sleeve with nails mounted therein at equal angles respectively to corresponding imaginary radial lines of the roll.

4 Claims, 8 Drawing Figures

APPARATUS FOR PUNCHING HOLES IN BOARDS

TECHNICAL FIELD

This invention relates generally to sound absorbent ceiling panels and more particularly to apparatus for punching holes in boards to increase the sound absorbency thereof.

BACKGROUND ART

U.S. Pat. No. 4,326,909 discloses apparatus for punching holes in a kraft paper backed aluminum foil facing on foamed plastic sheathing boards, for moisture permeability. The punching tacks extend radially of the mounting roll and their penetrating into the board is minimal. The tack heads are retained with limited movement by a rigid metal sleeve.

Ceiling panels made of fabricated fibrous boards are processed so as to have a relatively high density when low sound transmission and good fire resistance are desired. Sound absorbency of such boards is enhanced by punching holes therein. Formerly holes were punched in such boards in a reciprocable punch press. The process was labor intensive and too slow for economic production.

DISCLOSURE OF INVENTION

In accordance with the invention, apparatus is provided for punching relatively deep holes in fabricated fibrous boards in a continuous process. The apparatus includes a rotatably driven roll with nails resiliently mounted thereon for pivotal movement respectively about axes parallel to the rotational axis of the roll and normally extending at angles respectively to corresponding imaginary radial lines of the roll. The normal nail inclination and the resilient mounting enable each nail to enter and leave a board perpendicularly thereto and to remain perpendicular to the board all during the punching and return strokes while the roll is rotating and the board is passing therebeneath.

BRIEF DESCRIPTION OF DRAWINGS

The invention is hereinafter described in greater detail with reference to the accompanying drawings in which.

BEST MODE OF CARRYING OUT THE INVENTION

Figure 1:
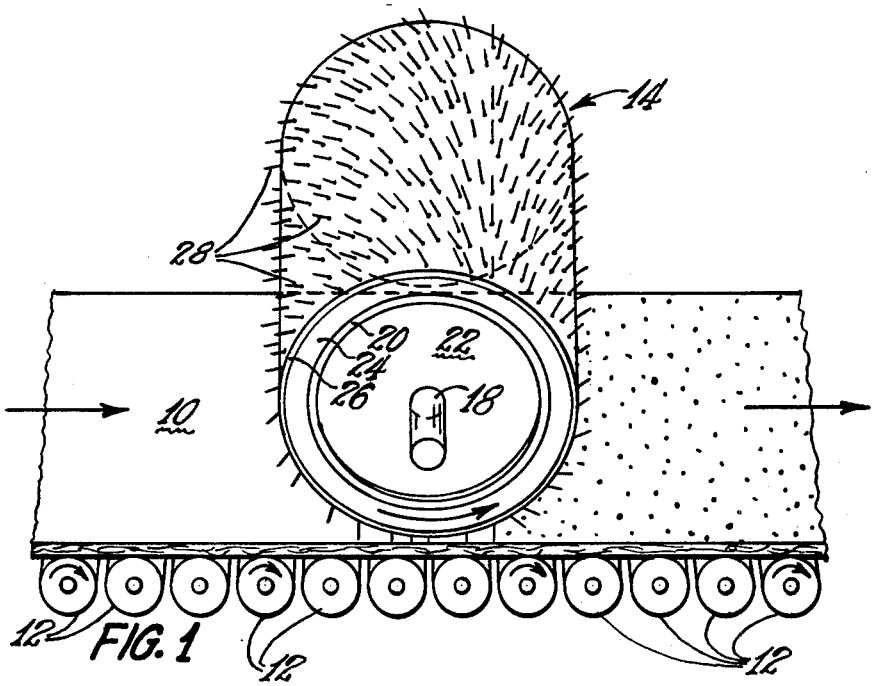
FIG. 1 is a somewhat schematic fragmentary perspective view of hole punching apparatus constructed in accordance with the invention.
Figure 2:
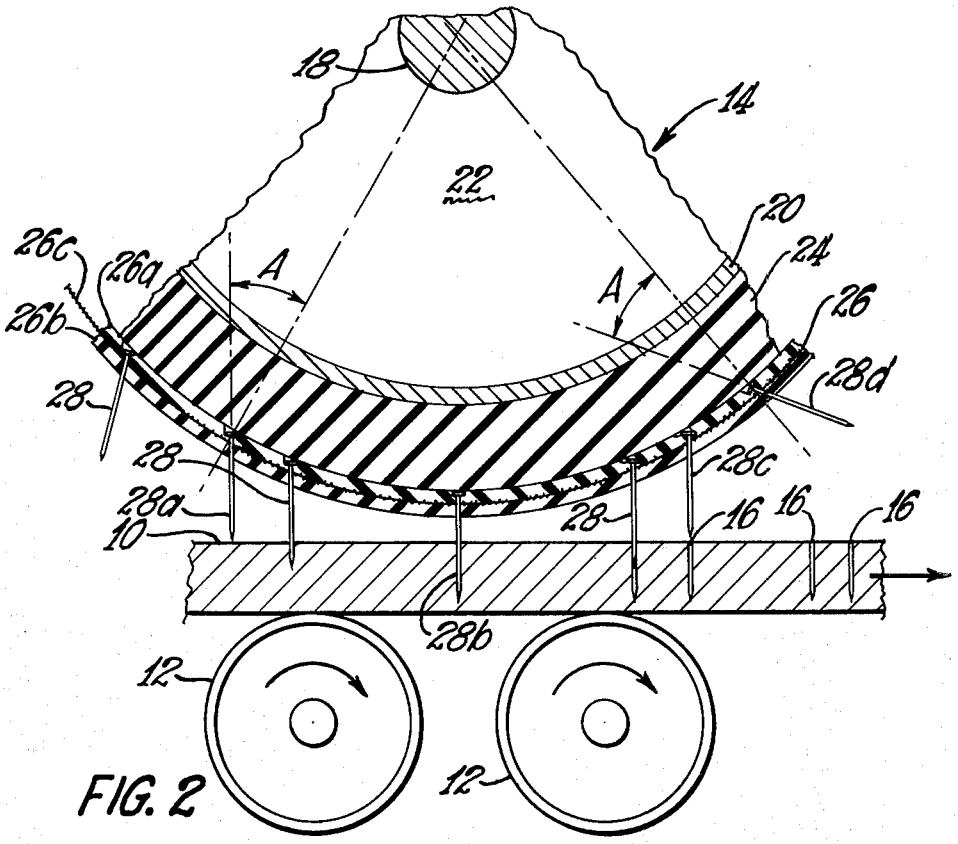
FIG. 2 is a fragmentary elevational view, partially in section, taken axially of a punching roll forming a portion of the apparatus of FIG. 1.

With reference to the drawings, FIGS. 1 and 2 show a fabricated fibrous board 10 traveling along a roller conveyor represented by a plurality of rollers 12. The board 10 passes beneath a rotatably driven hole punching roll 14 and has holes punched therein, such as holes 16 indicated in FIG. 2.

The punching roll 14 includes a central shaft 18 having a cylindrical sleeve 20 concentrically mounted thereon by a pair of end collars 22, a back-up roll 24 mounted on the sleeve 20, and a sleeve 26 mounted on the roll 24. The sleeve 26 may consist of inner and outer layers **26*a* and 26*b* of elastomeric material with a reinforcing woven screen 26*c*** therebetween.

Numerous hole punching members or nails 28 are mounted in the elastomeric sleeve 26 in a desired pattern for holes 16 to be punched in the board 10. The nails 28 are mounted with their heads on the inside of the sleeve 26 and their shanks extending through the sleeve 26 and projecting outwardly therefrom. In accordance with the invention, each nail 28 is mounted with its shank normally extending at a particular angle A from a radial line of the roll 14 drawn through the head of the nail, as indicated in FIG. 2. For example, as viewed in FIG. 2, the normal mounted position of a nail **28*a* about to enter the board 10 is counter-clockwise by the angle A from a radial line of the roll 14 drawn through the head of the nail. The angle A is such that the nails 28 enter the board 10 perpendicularly thereto, being driven therein by the back-up roll 24 of the punching roll 14 as the board moves to the right and the roll 14 rotates counter-clockwise with a surface speed of the sleeve 26 approximately equal to the speed of the board 10. Once started into the board 10 perpendicularly, the nails 28 remain perpendicular thereto for their full entering and withdrawing strokes. The nail 28*b* is shown as far into the board 10 as it will penetrate. In this position, it has been pivoted clockwise out of its normal mounted position through the angle A. The nail 28*c* is shown just after having been withdrawn from the board 10. In the position shown, it has been pivoted clockwise out of its normal mounted position through an angle 2A, but immediately after its having been withdrawn, the stress in the elastomeric sleeve 26 will cause it to pivot counter-clockwise through an angle 2A back to its normal mounted position, such as is shown for the nail 28*d***.

The punching roll 14 may be rotatably driven at a controlled speed by any suitable means. Further, any suitable conveying means may be used to support and move the board 10 at a controlled speed. While the punching roll 14 was designed to punch holes 16 in boards 10 of relatively high density, such as mineral fiber boards having a density of about fifteen pounds per cubic foot, it can also be used to punch holes in lighter boards, such as fibrous glass boards, whether painted or faced with plastic film.

Figure 3:
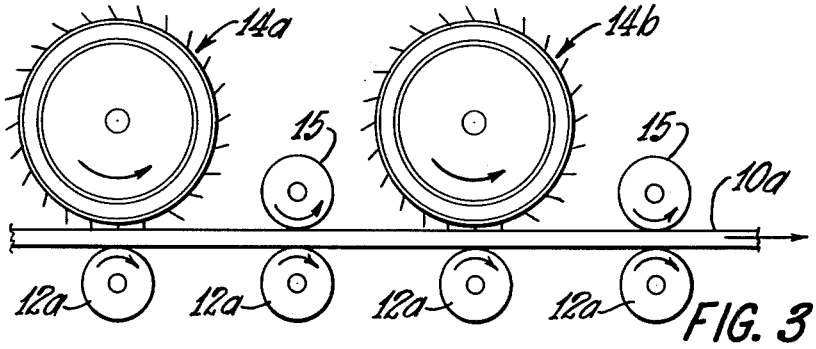
FIG. 3 is a fragmentary elevational view of hole punching apparatus constructed in accordance with the invention and illustrating the use of two punching rolls, the view being taken axially of the punching rolls.

FIG. 3 shows a pair of punching rolls 14*a* and 14*b*, similar to the punching roll 14 of FIGS. 1 and 2, operating on a board 10*a* supported by and traveling along conveyor means represented by rollers 12*a*. More holes or holes of different diameters can be provided in the board 10*a* with this arrangement. For example, the punching roll 14*a* may be provided with nails of a different size from those on the punching roll 14*b*. Hold-down rolls 15 may be provided if desired.

Figure 4:
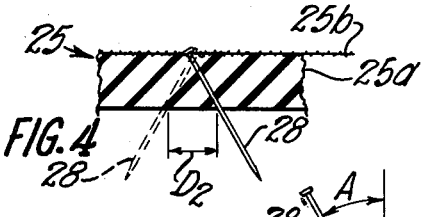
FIG. 4 is a fragmentary sectional view showing an embodiment of a belt and punching nail assembly forming a portion of a punching roll of the invention and illustrating a normal position of a nail in full lines, the normal position being a board entering position, and an extreme displaced position in broken lines, the displaced position being a board exiting position.

FIG. 4 shows a sleeve 25 in a straight-line representation. The sleeve 25 represents an earlier embodiment of the sleeve 26 and includes a layer 25*a* of elastomeric material and a reinforcing woven screen 25*b* at an inner surface thereof.

Figure 5:
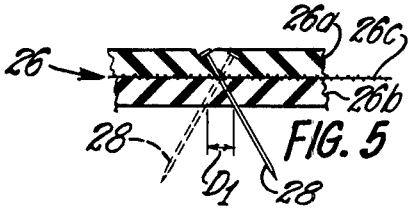
FIG. 5 is a fragmentary sectional view similar to FIG. 4, but showing a preferred embodiment of a belt and punching nail assembly, the preferred embodiment also being shown in FIG. 2.

FIG. 5 illustrates the sleeve 26 in a straight-line representation and shows one of the nails 28 in full lines in its normal mounted position and in broken lines in its extreme pivoted position, the normal mounted position comparing to that of the nails 28*a* and 28*d* in FIG. 2 and the extreme pivoted position comparing to that of the nail 28*c* in FIG. 2. The distance $D_2$ (FIG. 4) that a nail 28 displaces elastomeric material at the outer surface of the layer 25*a* when moving from its normal to extreme pivoted position is about twice the distance $D_1$ (FIG. 5) that a nail 28 displaces elastomeric material at the outer surface of the layer 26*b*. Therefore the layer 25*a* is subject to faster deterioration when in use, and the structure of FIGS. 2 and 5 is the preferred embodiment.

Figure 6:
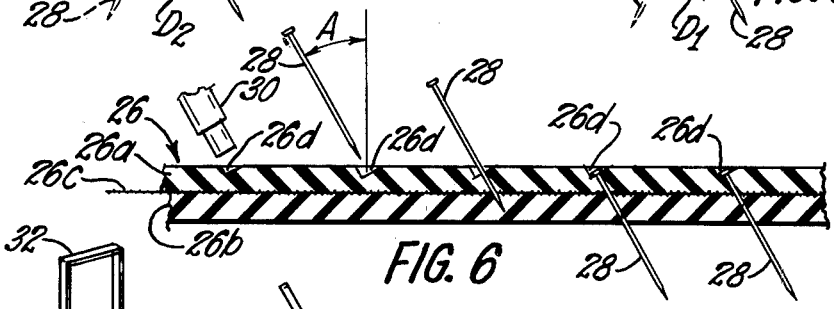
FIG. 6 is a fragmentary sectional view illustrating steps in the manufacture of the belt and punching nail assembly of FIGS. 2 and 5.

FIG. 6 illustrates the sleeve 26 in a straight-line representation and shows how the nails 28 are installed. A cutting or burning tool 30 may be used to form recesses 26*d* in the inner surface of the layer 26*a* of elastomeric material. For the nails 28, the recesses 26*d* are circular recesses with inclined surfaces. The nails 28 are inserted through the elastomeric layers 26*a* and 26*b* and the woven screen 26*c* at the angle A to the vertical, which corresponds to a radial line of FIG. 2.

Figure 7:
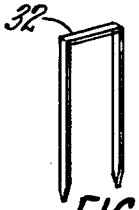
FIG. 7 is a perspective view of a staple, such staples being useable in place of nails in a punching roll constructed in accordance with the invention.
Figure 8:
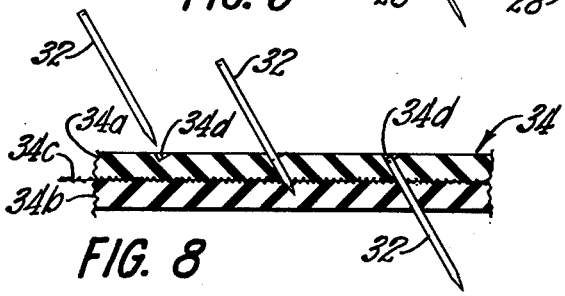
FIG. 8 is a view similar to FIG. 6 illustrating steps in the manufacture of a belt and punching staple assembly useable in a punching roll constructed in accordance with the invention.

FIG. 7 shows a staple 32 of a type which may be used in place of nails 28. FIG. 8 is a view similar to FIG. 6, but with staples 32 substituted for nails 28 in an elastomeric sleeve 34 having inner layer 34*a*, outer layer 34*b*, woven screen reinforcement 34*c*, and recesses 34*d*, the recesses having inclined surfaces and being elongated transversely of the sleeve 34.

While the angle of inclination A of a nail 28 from a corresponding imaginary radial line of the punching roll 14 is shown as being such that the nail is disposed perpendicularly to the board 10 at the time of its entry thereinto, the apparatus of this invention is not so limited. Other angles of inclination for the nails 28 may be used to produce straight elongated holes 16 in the board 10 having their longitudinal axes extending angularly to the surface of the board 10.

Various modifications may be made in the structure shown and described without departing from the scope of the invention as set forth in the following claims.

We claim:

1. Apparatus for punching holes in boards in a continuous process, said apparatus comprising a rotatably mounted punching roll having a sleeve of elastomeric material and a plurality of elongated hole punching members yieldably mounted therein for pivotal movement in planes perpendicular to an axis of rotation of the roll, means for supporting and moving a board past said punching roll into and out of operative engagement with said hole punching members, said hole punching members extending through said sleeve and projecting from an outer surface thereof, and each of said hole punching members in a normal mounted position being inclined, from a radial line of the punching roll extending through a mounted end of the hole punching member, in such a manner as to dispose a free end of the hole punching member forwardly of the mounted end in the direction of rotation of the punching roll, through a mounting angle such that the hole punching member extends perpendicularly to the board at the first contact of the free end therewith, the hole punching member remaining perpendicular to the board all during entry thereinto and withdrawal therefrom, being pivoted backwardly on the punching roll through twice said mounting angle during entry into and withdrawal from the board as the punching roll rotates and the board translates, and being restored to normal mounted position, upon withdrawal from the board, solely by said elastomeric sleeve.

2. Apparatus as claimed in claim 1 wherein the sleeve of elastomeric material is provided with a woven screen reinforcement.

3. Apparatus as claimed in claim 2 wherein the woven screen reinforcement is disposed substantially midway between an inner and said outer surface of said sleeve.

4. Apparatus as claimed in claim 2 wherein the woven screen reinforcement is disposed substantially at an inner surface of said sleeve.

* * * * *